US007062201B2

(12) United States Patent
Mizoguchi

(10) Patent No.: US 7,062,201 B2
(45) Date of Patent: Jun. 13, 2006

(54) IMAGE FORMING APPARATUS AND PROCESS CARTRIDGE FOR THE SAME

(75) Inventor: Yoshihiro Mizoguchi, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/984,969

(22) Filed: Nov. 10, 2004

(65) Prior Publication Data

US 2005/0123319 A1 Jun. 9, 2005

(30) Foreign Application Priority Data

Nov. 10, 2003 (JP) ..... P. 2003-379747

(51) Int. Cl.
*G03G 21/18* (2006.01)

(52) U.S. Cl. ..... 399/114; 399/111; 399/107; 399/119

(58) Field of Classification Search ..... 399/114, 399/111, 107
See application file for complete search history.

(56) References Cited

U.S. PATENT DOCUMENTS

| | | | | |
|---|---|---|---|---|
| 6,002,896 | A * | 12/1999 | Miyamoto et al. | 399/114 |
| 6,859,632 | B1 * | 2/2005 | Dougherty | 399/111 |
| 2003/0161655 | A1 * | 8/2003 | Fukuda et al. | 399/111 |
| 2003/0185587 | A1 * | 10/2003 | Kawai et al. | 399/111 |

FOREIGN PATENT DOCUMENTS

| | | |
|---|---|---|
| JP | 4-140770 | 5/1992 |
| JP | 2002-006722 | 1/2002 |

OTHER PUBLICATIONS

English Language Abstract of JP 4-140770.
English Language Abstract of JP 2002-6722.

* cited by examiner

*Primary Examiner*—Arthur T. Grimley
*Assistant Examiner*—Ryan D. Walsh
(74) *Attorney, Agent, or Firm*—Greenblum & Bernstein, P.L.C.

(57) ABSTRACT

An image forming apparatus having a process cartridge that includes a first protective member which is attached to one end in the longitudinal direction of the process cartridge and holds a photoconductor drum 2*a* and a development roller 2*b* spacially, and a second protective member which is attached to a rotational shaft end of the photoconductor drum 2*a* and prevents rotation of the photoconductor drum 2*a*.

30 Claims, 10 Drawing Sheets

IMAGE FORMING APPARATUS AND PROCESS CARTRIDGE FOR THE SAME

BACKGROUND OF THE INVENTION

The present invention relates to an image forming apparatus and a process cartridge removably attached to a main body of an electrophotographic image forming apparatus, and particularly to a protective member used in conveyance and storage of a process cartridge.

Heretofore, in an image forming apparatus which adopts electrophotography, a photoconductor that is an image bearing member has been charged by a charger, light irradiation according to image data has been performed on the charged photoconductor thereby to form a latent image, this latent image has been developed by a developing device, and the developed toner image has been transferred onto a recording medium, whereby an image has been formed.

On the other hand, with colorization of an image, a tandem type color image forming apparatus has been also proposed, which has plural process cartridges in which each of the above image forming processes is executed, forms a toner image of each color of cyan, magenta, yellow, and preferably black on each photoconductor, and multi-layer transfers these toner images onto an endless intermediate transfer member in a transfer position of each photoconductor, thereby to form a full color image.

Since such the tandem type color image forming apparatus has each image forming section of each color, it is advantageous for speed-up.

A conventional tandem type color image forming apparatus will be described below.

FIG. 7 is a diagram showing a state in which a conventional process cartridge protective member is to be attached. In conveyance and storage of process cartridge 2 to 5, by the continuous pressure-contact state between the developing roller 2*b* to 5*b* and the photoconductor drum 2*a* to 5*a*, contact traces (nip line) of the development roller on a pressure-contact part of photoconductor drum 2*a* to 5*a*, and stains on the photoconductor drum 2*a* to 5*a* due to oil components of the developing roller 2*b* to 5*b* moving from its rubber components are caused. The protective member is attached in order to prevent the contact traces and the stains.

FIG. 8 is a diagram showing a state in which the conventional process cartridge protective member has been attached.

In FIG. 7, reference numerals 14*a* and 14*b* are protective members which are inserted into the process cartridge 2 to 5 apart from the center in the longitudinal direction to the left and the right by the predetermined distance, thereby to space the photoconductor drum 2*a* to 5*a* and the pressure-contact part (nip part) of the development roller 2*b* to 5*b* which are formed in the process cartridge 2 to 5. Further, reference numeral 15 is a photoconductor drum protective cover for protecting the photoconductor drum 2*a* to 5*a* exposed to an opening part of the process cartridge 2 to 5. The protective members 14*a* and 14*b* are attached in two positions which are right and left symmetrical in order to space the photoconductor drum 2*a* to 5*a* and the development roller 2*b* to 5*b* uniformly in the axial direction.

FIG. 9 is a diagram showing a state in which another conventional process cartridge protective member is to be attached. This process cartridge protective member has a size covering the nearly entire region in the longitudinal direction of the process cartridge 2 to 5. FIG. 10 is a diagram showing a state in which another conventional process cartridge protective member has been attached. Further, other process cartridge protective members have been also disclosed in JP-A-4-140770 and JP-A-2002-6722.

However, in packing and conveying states of the process cartridge, in case that the process cartridge has been stored for a long period, the pressure-contact state between the developing roller and the photoconductor drum is continued, whereby such a problem is produced that the contact traces (nip line) of the development roller are produced on the pressure-contact part of the photoconductor drum, or the photoconductor drum surface is stained with oil components moving from rubber components of the developing roller. In order to solve such the problem, the countermeasure as described in the above background art has been taken. However, in the conventional constitution, since the members for spacing the photoconductor drum and the development roller must be attached in the right and left two positions in the longitudinal direction of the process cartridge, the two operations must be performed in packing or renewing the process cartridge. If the single space member is formed, it must be formed at the wastefully large size.

Further, in case of a type in which a charge roller is provided in contact with a photoconductor drum, that is, in case of a contact electrification type process cartridge, vibration in conveyance causes reverse rotation of the photoconductor drum, whereby the charge roller is stained, so that bad printing is caused.

SUMMARY OF THE INVENTION

Therefore, an object of the invention is to provide in image forming apparatus and a process cartridge therefor in that a member for holding space between a photoconductor drum and a development roller and preventing reverse rotation of the photoconductor drum in conveyance and storage of the process cartridge is formed by simple constitution and attached or detached easily.

In order to solve these problems, a process cartridge of the invention includes a photoconductor drum that rotates in the circumferential direction, on which an electrostatic latent image corresponding to a toner image is formed; a development roller that is arranged opposed to the photoconductor drum, and makes the electrostatic latent image formed on the photoconductor drum visible thereby to form a toner image; and an opening part from which the photoconductor drum is partially exposed in the longitudinal direction, wherein the photoconductor drum and the development roller are held in the process cartridge contactably and separatably, and there are provided a first member that is attached to one end in the longitudinal direction of the process cartridge, and holds the photoconductor drum and the development roller spacially, or a second member that is attached to a rotational shaft end of the photoconductor drum to obstruct rotation of the photoconductor drum.

Preferably, a photoconductor drum protective cover that covers the opening part is provided detachably from the process cartridge, the first member is previously attached to the photoconductor drum protective cover, and is attached to or detached from one end part in the longitudinal direction of the process cartridge correspondingly to the attachment and detachment operations of the photoconductor drum protective cover.

Further, splines which are fitted to a photoconductor drive shaft for transmitting the drive force by spline coupling provided for the apparatus body when the process cartridge is attached to the image forming apparatus body is formed at the shaft end of the photoconductor drum, and the second member has a spline fitted to the spline formed at the rotational shaft end of the photoconductor drum. Preferably, regarding a first spline formed at the photoconductor drum in the axial direction, and a second spline formed at the second member, at least one spline part of the first spline is longer than other first spline parts, or at least one spline part of the second spline is longer than other second spline parts.

As described above, according to the invention, in packing or exchanging of the process cartridge, the member for holding space between the photoconductor drum and the development roller can be attached or detached by easy operation, and prevention of the reverse rotation of the photoconductor drum can prevent the stains of the charge roller, so that an effective advantage that good printing quality can be secured can be obtained.

DETAILED DESCRIPTION OF THE PREFERRED EMBODIMENTS

Figure 1:
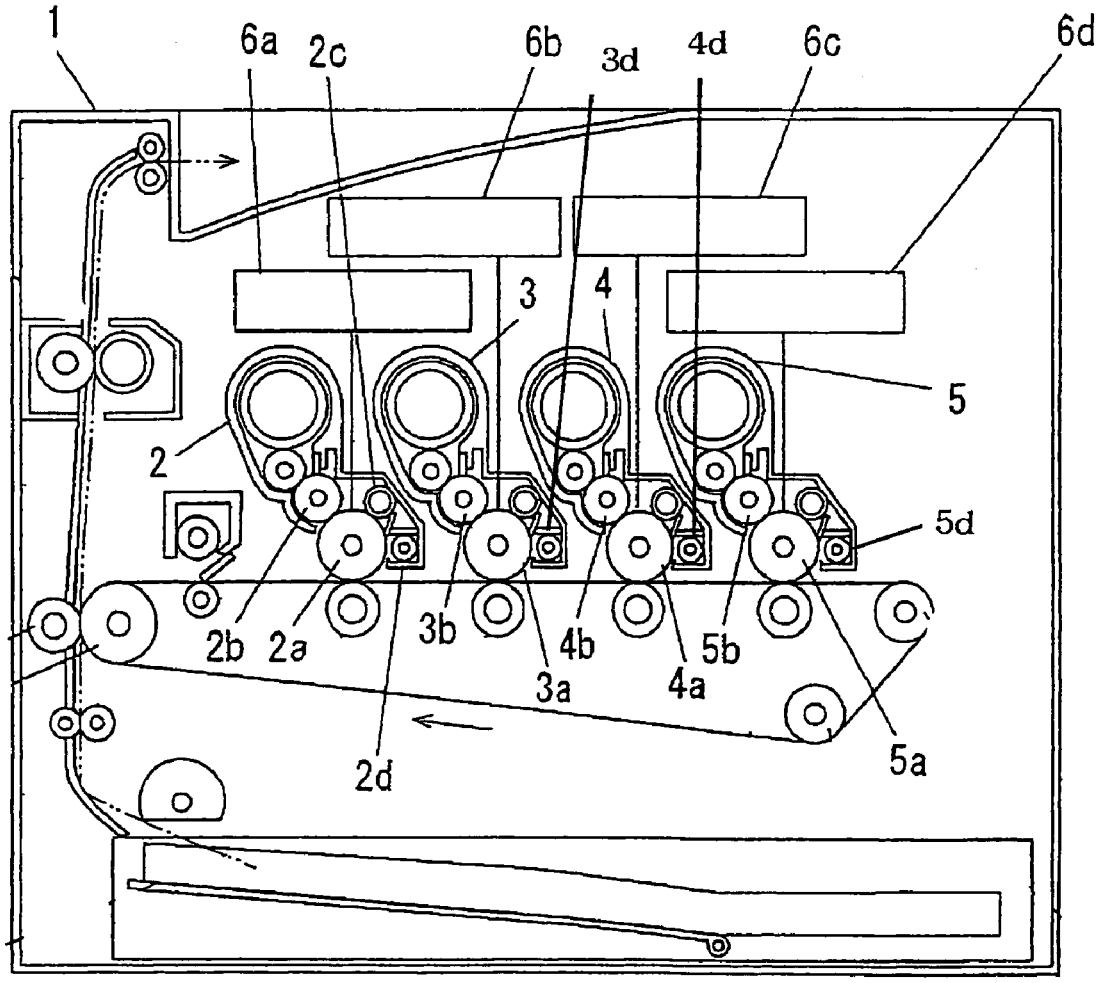
FIG. 1 is a schematic diagram showing the constitution of a color image forming apparatus according to an embodiment of the invention.

A first embodiment of the invention will be described with reference to FIGS. 1 to 6. In these drawings, the same members are denoted by the same reference numerals, and the overlapped description is omitted.

First Embodiment

Figure 2:
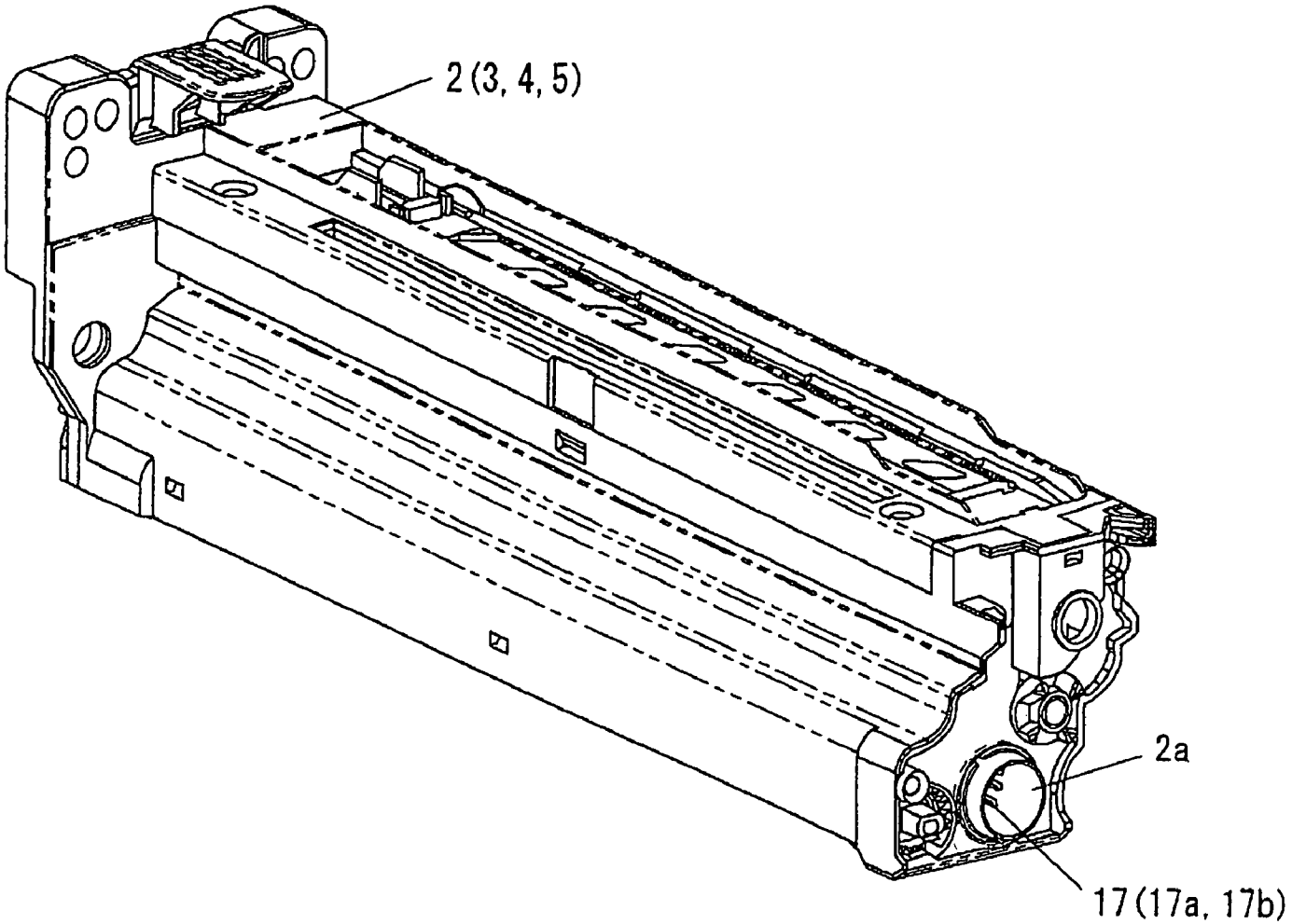
FIG. 2 is a perspective view showing a process cartridge according to the embodiment of the invention.
Figure 3:
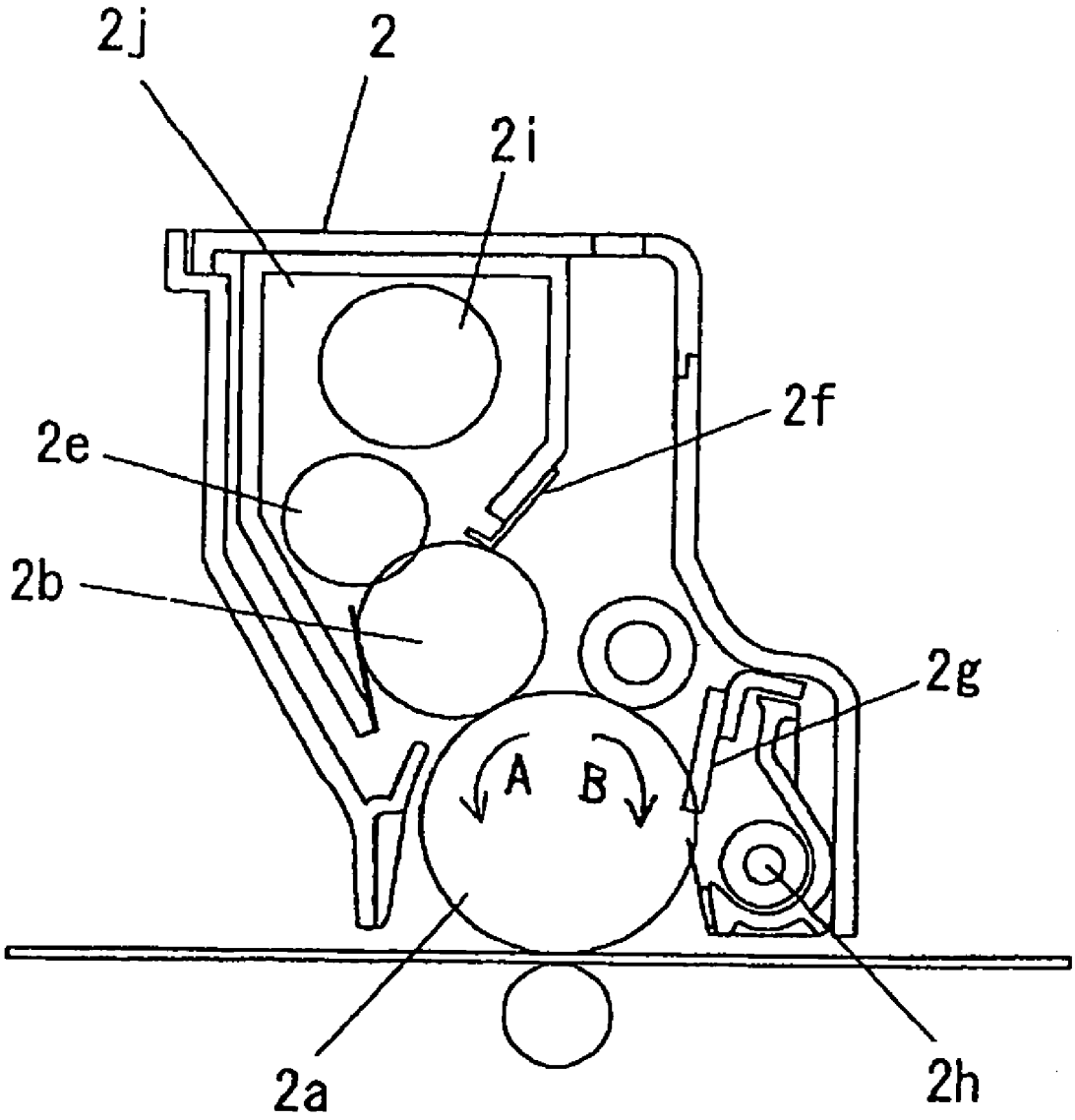
FIG. 3 is a sectional view of the process cartridge in FIG. 2.
Figure 4:
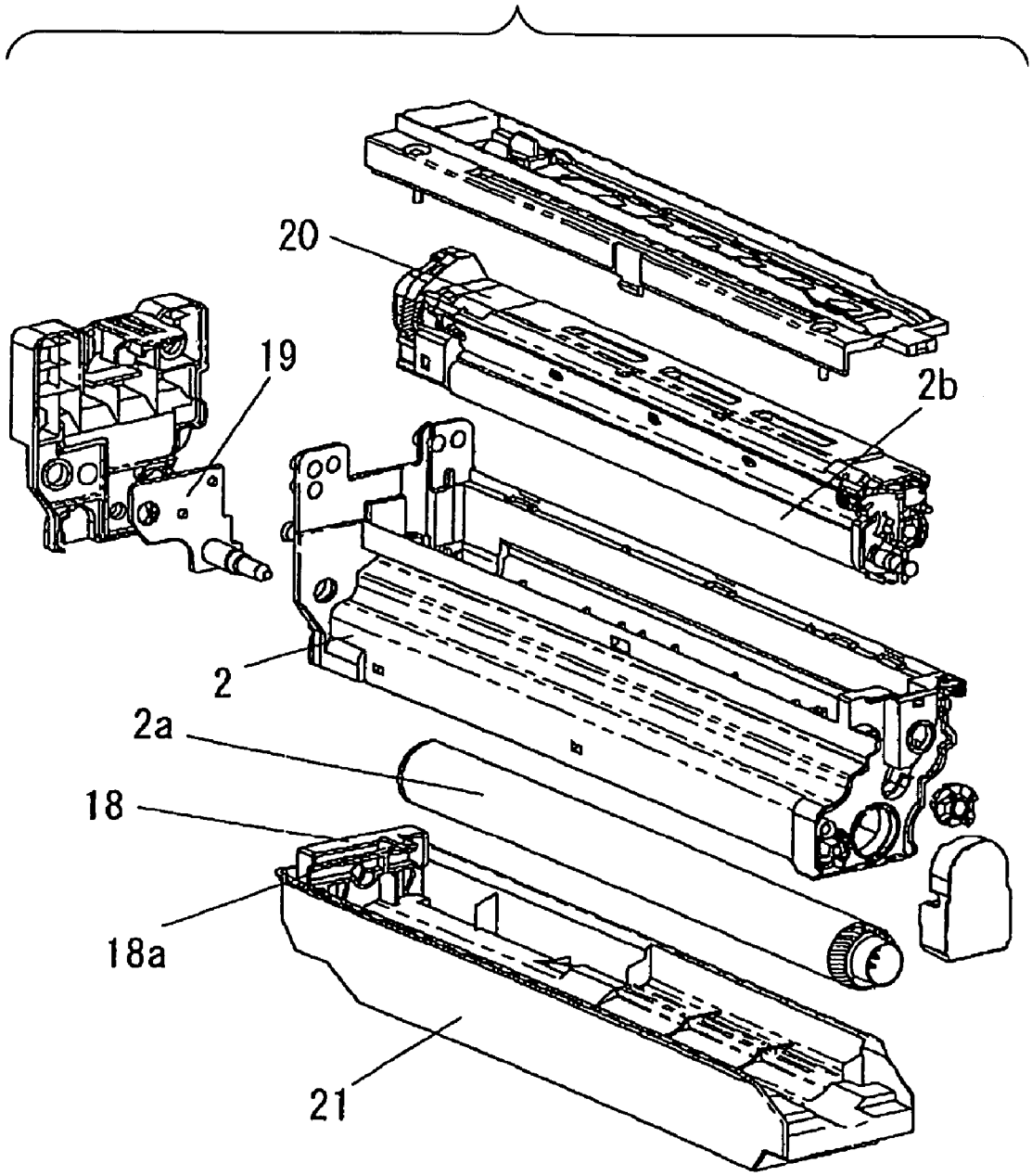
FIG. 4 is an exploded perspective view of the process cartridge including protective members according to the embodiment of the invention.
Figure 5:
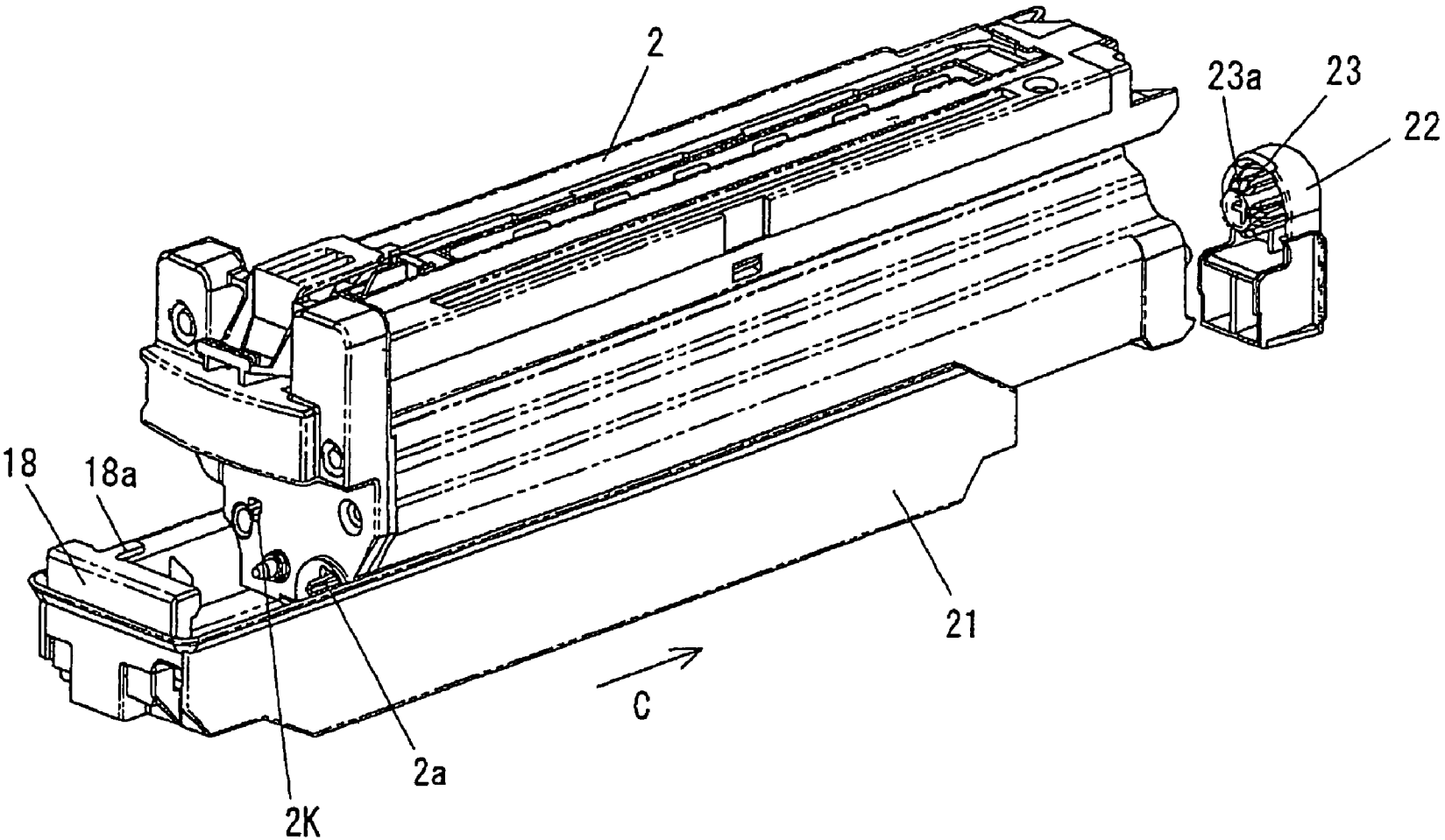
FIG. 5 is a perspective view showing a state in which the protective members according to the embodiment of the invention are being attached.

FIG. 1 is a schematic diagram showing the constitution of a color image forming apparatus according to an embodiment of the invention, FIG. 2 is a perspective view showing a process cartridge according to the embodiment of the invention, FIG. 3 is a sectional view of the process cartridge in FIG. 2, FIG. 4 is an exploded perspective view of the process cartridge including protective members according to the embodiment of the invention, and FIG. 5 is a perspective view showing a state in which the protective members according to the embodiment of the invention are being attached.

Figure 6:
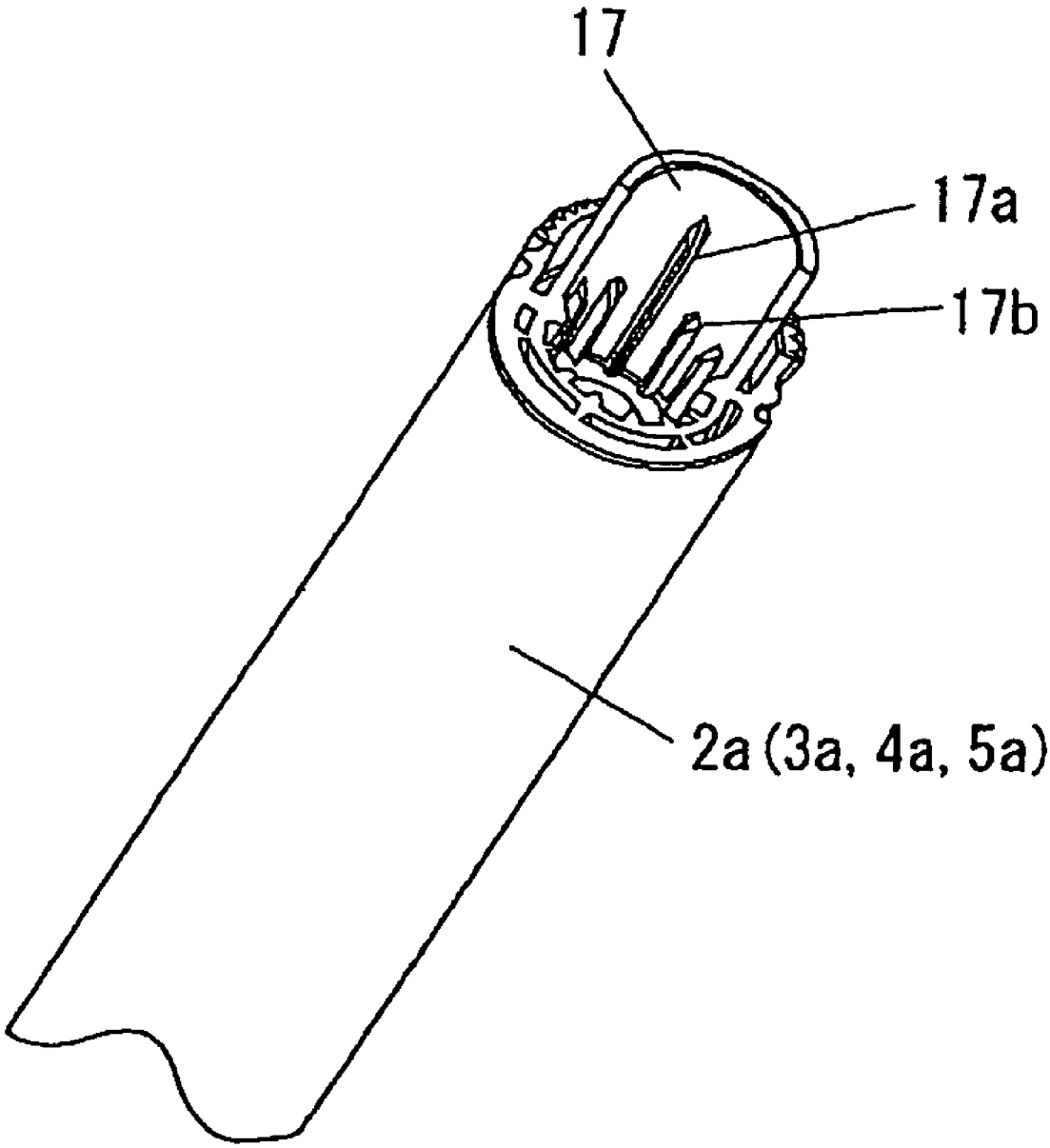
FIG. 6 is a detailed diagram showing a second member for preventing reverse rotation of a photoconductor drum according to the embodiment of the invention, and an end part of a photoconductor drum drive shaft.
Figure 7:
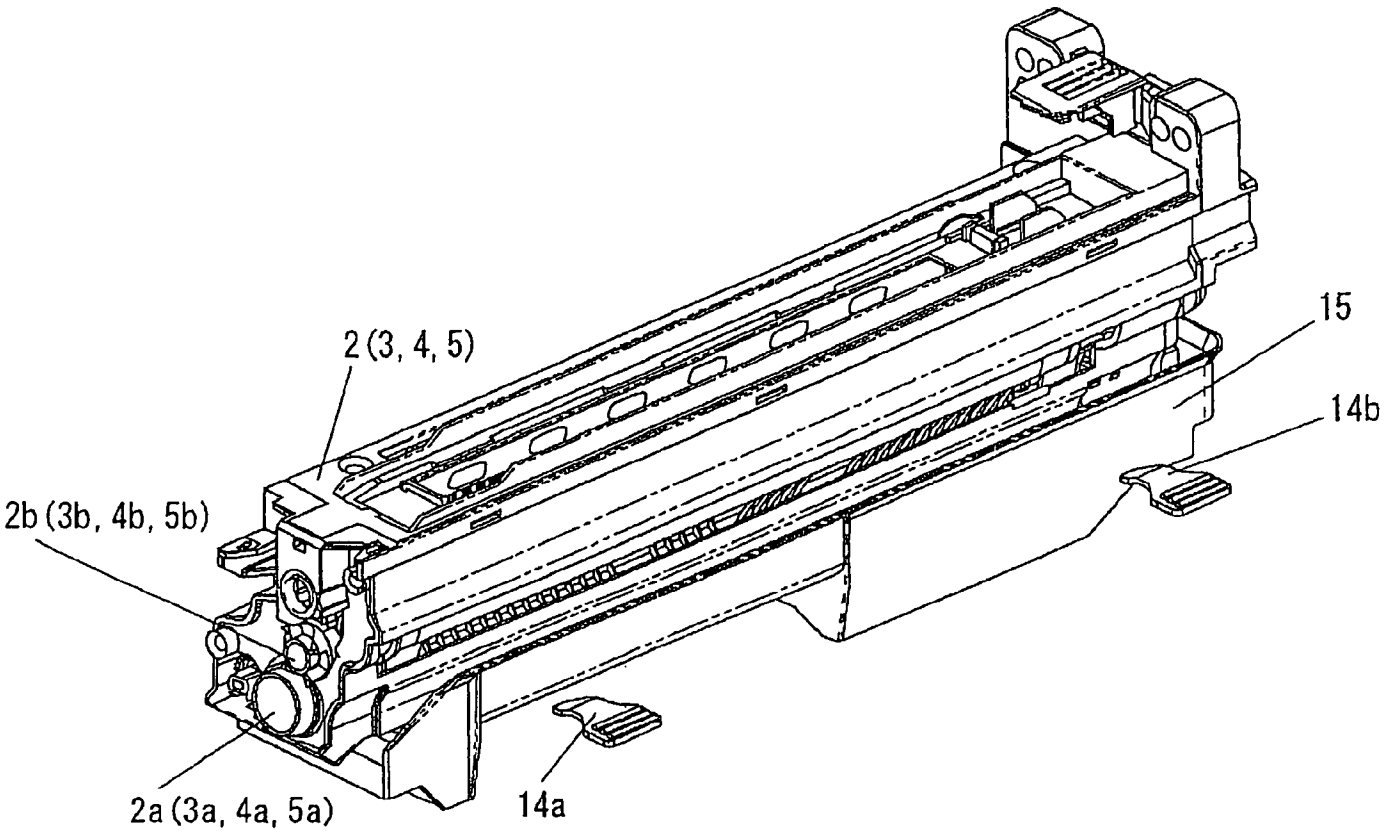
FIG. 7 PRIOR ART
FIG. 7 is a diagram showing a state in which a conventional process cartridge protective member is to be attached.
Figure 8:
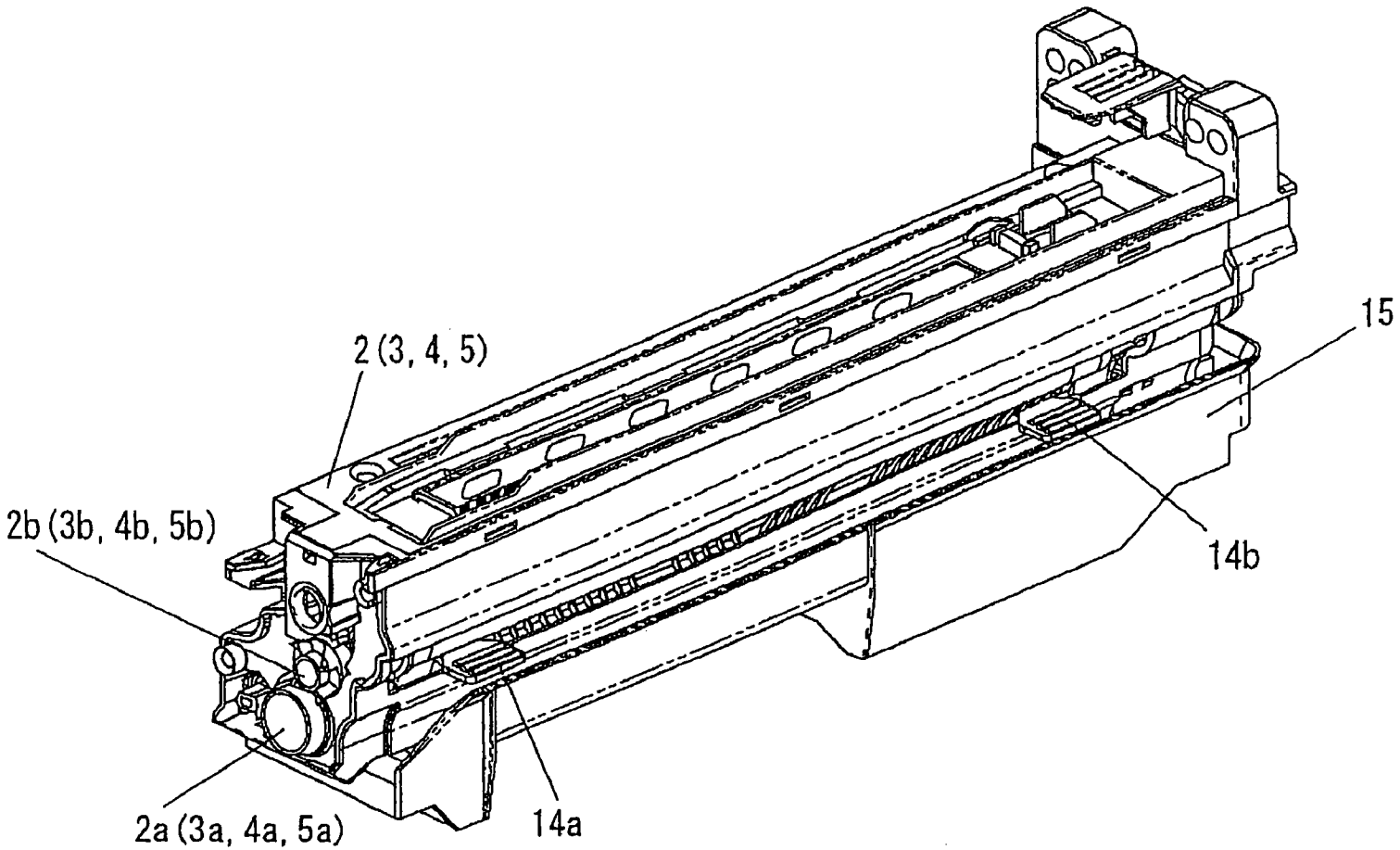
FIG. 8 PRIOR ART
FIG. 8 is a diagram showing a state in which the conventional process cartridge protective member has been attached.
Figure 9:
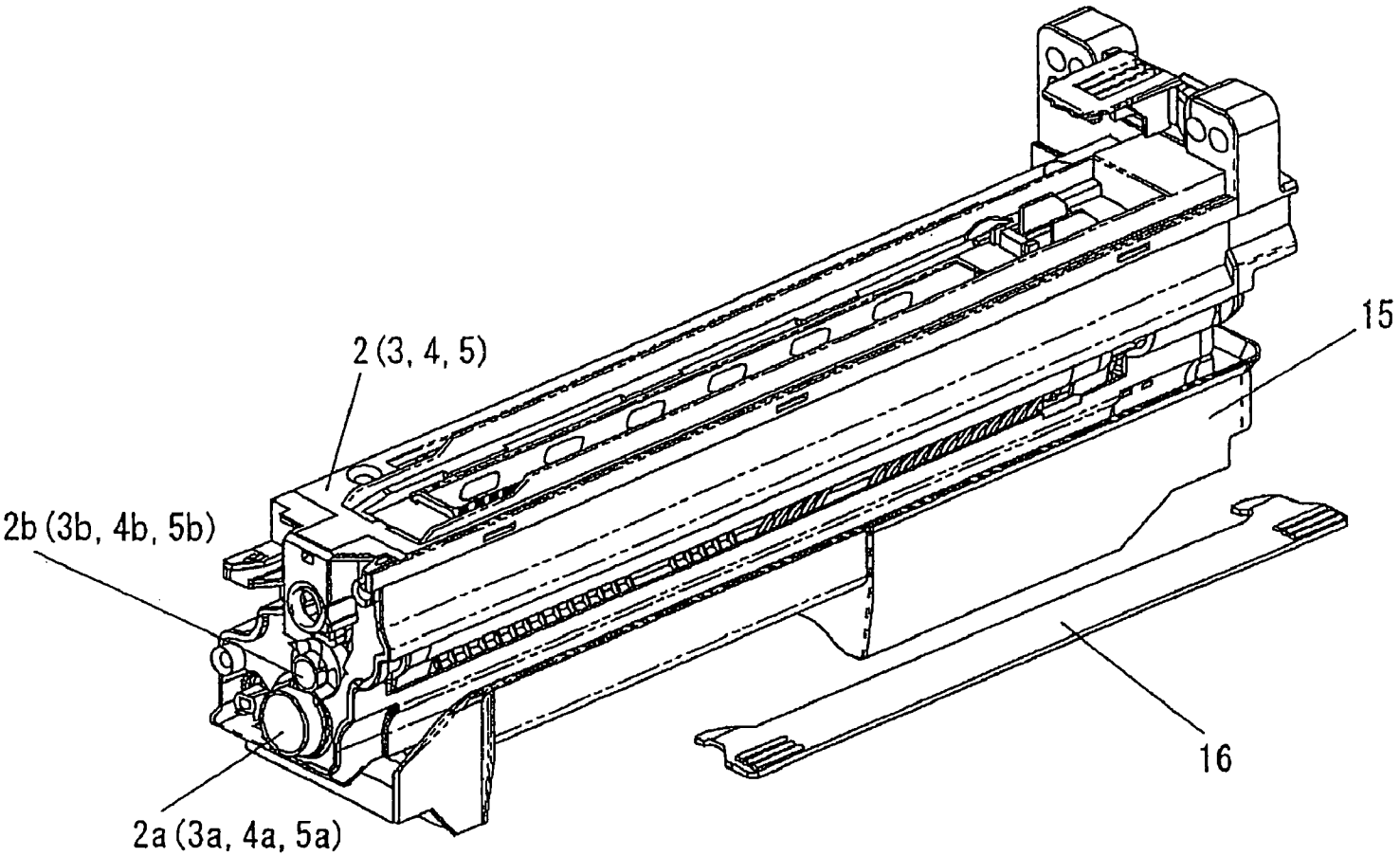
FIG. 9 PRIOR ART
FIG. 9 is a diagram showing a state in which another conventional process cartridge protective member is to be attached.
Figure 10:
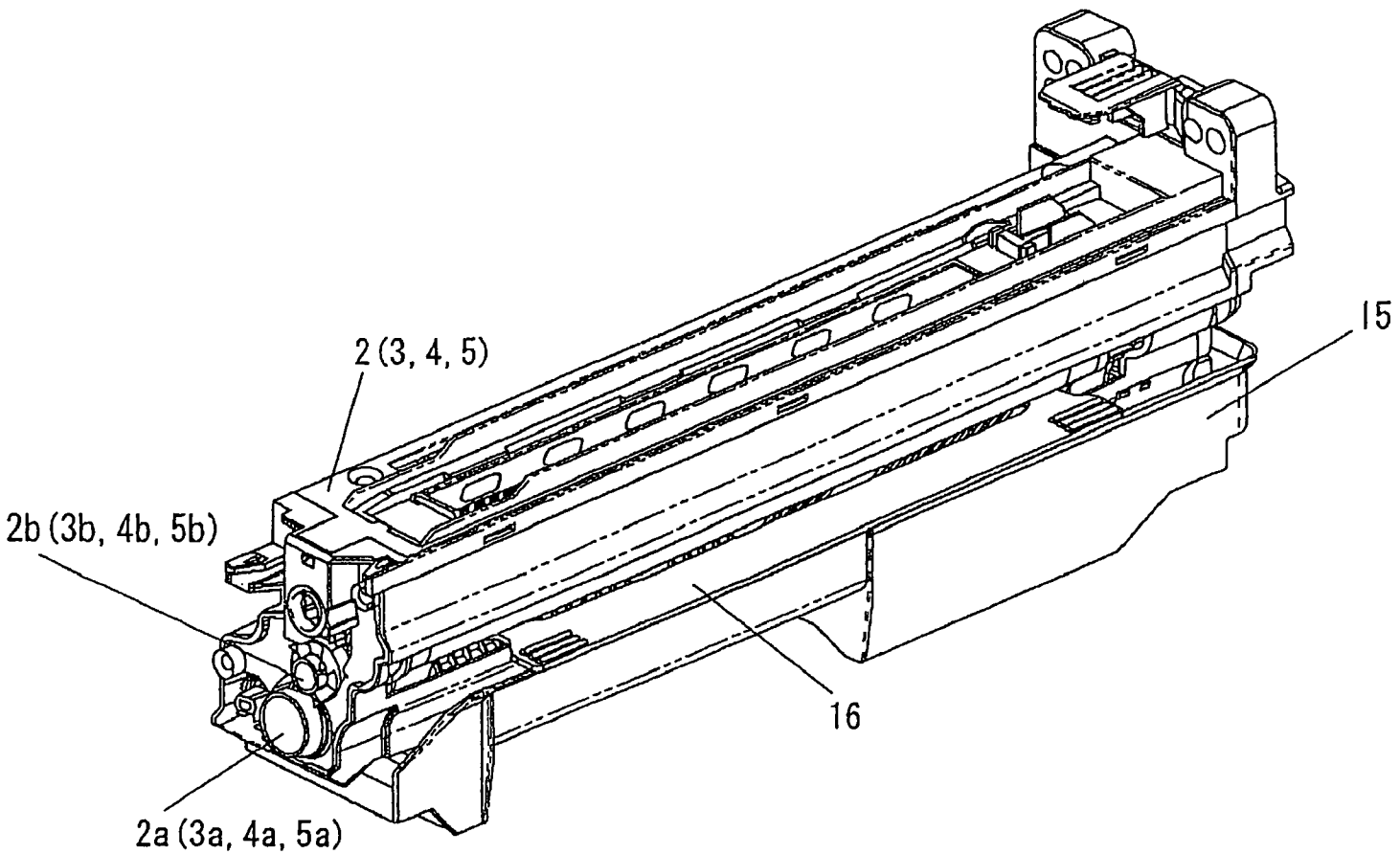
FIG. 10 PRIOR ART
FIG. 10 is a diagram showing a state in which another conventional process cartridge protective member has been attached.

FIG. 6 is a detailed diagram showing a second member for preventing reverse rotation of a photoconductor drum according to the embodiment of the invention, and an end part of a photoconductor drum drive shaft.

In FIG. 1, in a main body 1 of the color image forming apparatus, process cartridges 2, 3, 4, and 5 for respectively forming a toner image of each color of yellow (Y), magenta (M), cyan (C), and black (K) are detachably arranged in order. Correspondingly to these process cartridges 2 to 5, exposing devices 6*a*, 6*b*, 6*c*, and 6*d* are provided respectively.

The process cartridge 2 to 5 includes a photoconductor drum (photoconductor) 2*a*, 3*a*, 4*a*, 5*a* that is an image bearing member provided rotatably; a development roller (development means) 2*b*, 3*b*, 4*b*, 5*b* which causes toner supplied from a toner tank to adhere onto the photoconductor drum 2*a* to 5*a* on the peripheral surface of which an electrostatic latent image has been formed by irradiation of laser beams from an exposing device 6*a* to 6*d*, and makes the electrostatic latent image visible as a toner image; a charge roller 2*c*, 3*c*, 4*c*, 5*c*; and a toner exhausting screw 2*d*, 3*d*, 4*d*, 5*d*.

The photoconductor drums 2*a*, 3*a*, 4*a*, and 5*a* rotating in the circumferential direction are arranged in alignment so that their rotation axes become parallel to one another. FIG. 3 is a diagram showing a section of the process cartridge 2. Inside the other process cartridges 3 to 5, each element is arranged similarly.

In FIG. 3, reference numeral 2*e* is a developer supply roller for supplying developer in a developer housing 2*j* to the development roller 2*b*. Reference numeral 2*f* is a doctor blade which forms a fixed thin layer of the developer supplied by the developer supply roller 2*e* on a surface of the development roller. Reference numeral 2*g* is a cleaning blade which collects the developer remaining on the photoconductor drum 2*a* after first bias transfer and cleans the photoconductor drum 2*a*, and reference numeral 2*h* is a waste toner transporting screw for transporting the developer collected by the cleaning blade 2*g* to a waste toner box (not shown) provided separately. Reference numeral 2*i* is an agitator which agitates and transports the developer in the developer housing 2*j*.

In the thus constituted process cartridge 2, development bias is applied between the development roller 2*b* and the photoconductor drum 2*a*, and a supply roller bias is applied between the developer supply roller 2*e* and the development roller 2*b*. Further, the photoconductor drum 2*a* is rotation-driven in the direction of an arrow A during an image forming operation.

As shown in FIGS. 2 and 6, at the inner circumference of one end of the photoconductor drum 2*a*, a first spline 17 having plural tooth parts 17*a* and 17*b* extending axially is formed. This first spline 17 is, when the process cartridge 2 to 5 is attached to the image forming apparatus body, originally fitted to a gear part (not shown) formed at the periphery of each photoconductor drive shaft and used in order to transmit the drive force from the apparatus body.

In FIG. 4, reference numeral 18 is a non-drive transmission side end part of the process cartridge 2, and it functions as a first protective member having a tongue part 18*a*.

The tongue part 18*a* is provided, protruded from the non-drive transmission side end part 18 in the axial direction of the photoconductor drum 2*a*. The tongue part 18*a* is inserted between a rotational shaft support member 19 that rotation-supports the photoconductor drum 2*a* and a unit 20 into which the development roller 2*b* is built, thereby to act so as to space the support member 19 and the unit 20.

FIG. 5 shows the state where a photoconductor drum protective cover 21 is to be attached to the process cartridge 2. The photoconductor drum protective cover 21 to which the first protective member 18 has previously attached is slid from the non-drive transmission side end part of the process cartridge 2 in the direction of an arrow C so as to cover the opening part (not shown) thereby to be attached to the process cartridge 2. In cooperation with this attachment operation, the tongue part 18*a* formed in the first protective member 18 is inserted into a hole part 2*k* of the process cartridge 2, thereby to enter between the rotational shaft support member 19 that rotation-supports the photoconductor drum 2*a* and the unit 20 into which the development roller 2*b* is built and act so as to space the support member 19 and the unit 20. Hereby, the photoconductor drum 2*a* and the development roller 2*b* are kept in the spaced state.

Here, in this embodiment, the first protective member 18 and the photoconductor drum protective cover 21 are constituted separately, and the first protective member 18 is previously attached to the photoconductor drum protective cover 21. However, they may be formed integrally as components of the invention.

Next, in FIG. 5, reference numeral 22 is a second protective member which is attached to a drive transmission side end part of the process cartridge 2, and acts so as to obstruct rotation of the photoconductor drum 2*a*. As shown in FIG. 6, at the inner circumference of one end of the photoconductor drum 2*a*, the first spline 17 having the plural tooth parts 17*a* and 17*b* extending axially is formed. In the second protective member 22 shown in FIG. 5, a second spline 23 is formed so as to fit to this first spline 17.

As shown in FIG. 6, of the plural tooth parts 17*a* and 17*b* of the first spline 17 formed at each photoconductor drum 2*a* to 5*a*, the partial tooth part 17*a* (in this embodiment, a single tooth part 17*a* is shown) is longer axially than the other tooth parts 17*b*.

In this embodiment, though only the single tooth part 17*a* of the first spline 17 is longer than the other tooth parts 17*b*, more than two tooth parts may be longer. Namely, the length of at least one tooth part 17*a* may be different from the lengths of the other tooth parts 17*b* and may be longer.

Further, the partial tooth part 17*a* of the first spline 17 is not longer than the other tooth parts 17*b*, but the partial tooth part 23*a* of the second spline 23 may be longer. Alternatively, in both tooth parts 17*a* and 23*a* of the first spline 17 and the second spline 23, the partial tooth parts 17*a* and 23*a* may be made longer so as to be different in the axial length from the other tooth part 17*a* and 23*a*.

Further, at an end part of each tooth part 17*a*, 17*b*, 23*a*, a taper is provided in the axial direction and the rotational direction so that fitting can be performed smoothly even in case that the tooth parts come into contact with each other when the second protective member 22 is attached to the process cartridge 2 to 5.

In case that the second protective member 22 has not been attached to the process cartridge yet, the photoconductor drum 2*a* is kept rotatable. Therefore, due to vibration in conveyance of the process cartridge 2, the photoconductor drum 2*a* inside the process cartridge 2 rotates reversely in the direction of an arrow B as shown in FIG. 3, so that the charge roller 2C is stained with the toner adhering onto the surface of the photoconductor drum 2*a*. Therefore, the second protective member 22 is fitted to the first spline 17 formed on the drive shaft end side of the photoconductor drum 2*a*, and attached to the process cartridge, whereby the rotation of the photoconductor drum 2*a* is obstructed, and the stains of the charge roller 2C due to the reverse rotation of the photoconductor drum 2*a* is prevented in conveyance.

Though the invention is applied to the image forming apparatus forming the color image in the above description, it may be applied also to an image forming apparatus forming a monochromatic image.

According to the invention, the following effective advantages are obtained: in packing or exchanging of the process cartridge, the space holding member between the photoconductor drum and the development roller can be attached or detached by the easy operation; by prevention reverse rotation of the photoconductor drum, stains of the charge roller can be avoided; and good printing quality can be secured, so that the invention is useful for the process cartridge used in the electrophotographic image forming apparatus.

This application is based upon and claims the benefit of priority of Japanese Patent Application No. 2003-379474 filed on Nov. 10, 2003, the contents of which are incorporated herein by reference in its entirety.

What is claimed is:

1. An image forming apparatus comprising:

a photoconductor drum on which an electrostatic latent image corresponding to a toner image is formed;

a development roller which makes the electrostatic latent image on said photoconductor drum visible thereby to form the toner image;

a process cartridge which holds said photoconductor drum and said development roller; and a protective cover which is attachable to said process cartridge and covers said photoconductor drum and said development roller when the protective cover is attached to said process cartridge, wherein said protective cover has a tongue part that enters a nip part between said photoconductor drum and said development roller from an axial direction of an axis of said photoconductor drum when the protective cover is attached to said process cartridge thereby to space said photoconductor drum and said development roller.

2. The image forming apparatus according to claim 1, wherein said process cartridge includes an opening part from which said photoconductor drum is partially exposed in the longitudinal direction, and a first member that is attached to one end in the longitudinal direction of said process cartridge, arid holds said photoconductor drum and the development roller spatially.

3. The image forming apparatus according to claim 1, wherein said tongue part is provided at an end of the inside of said protective cover, and said tongue part enters an end of said nip part between said photoconductor drum and said development roller.

4. The image forming apparatus according to claim 2, wherein a photoconductor drum protective cover that covers said opening part is provided detachably from the process cartridge, and said first member is previously attached to said photoconductor drum protective cover.

5. The image forming apparatus according to claim 4, wherein said first member, correspondingly to the attachment and detachment operations of said photoconductor drum protective cover, is attached to or detached from one end part in the longitudinal direction of said process cartridge.

6. An image forming apparatus comprising:

a photoconductor drum on which an electrostatic latent image corresponding to a toner image is formed;

a development roller which makes the electrostatic latent image on said photoconductor drum visible thereby to form a toner image;

a process cartridge which holds said photoconductor drum and said development roller, and holds an axial end part in an axial direction of an axis of said photoconductor drum in the exposed state; and a protective member which is attached to said process cartridge and covers said photoconductive drum and said development roller in a state where it is fitted to said exposed axial end part of said photoconductor drum thereby to inhibit rotation of said photoconductor drum.

7. The image forming apparatus according to claim 6, wherein said process cartridge includes an opening part from which said photoconductor drum is partially exposed in the longitudinal direction, and a second member that is attached to a rotational shaft end of said photoconductor drum to obstruct rotation of said photoconductor drum.

8. The image forming apparatus according to claim 7, wherein a spline which is fitted to a photoconductor drive shaft for transmitting the drive force by spline coupling provided for the apparatus body when the process cartridge is attached to the image forming apparatus body is formed at the shaft end of said photoconductor drum, and said second member has a spline fitted to the spline formed at the rotational shaft end of said photoconductor drum.

9. The image forming apparatus according to claim 8, wherein regarding a first spline formed axially at said photoconductor drum, and a second spline formed at said second member, in one or both of said first spline and said second spline, at least one spline part of said first spline is longer than other first spline parts, or at least one spline part of said second splines is longer than other second spline parts.

10. The image forming apparatus according to claim 8, wherein a leading end of said first spline and a leading end of said second spline are provided respectively with a taper in order to smooth fitting in attachment of the second member.

11. The image forming apparatus according to claim 10, wherein said taper is formed in an axial direction of an axis of said photoconductor drum and the rotational direction of said photoconductor drum and said second member.

12. A process cartridge comprising:

a photoconductor drum that rotates in the circumferential direction, on which an electrostatic latent image corresponding to a toner image is formed;

a development roller that is arranged opposed to said photoconductor drum, and makes said electrostatic latent image formed on said photoconductor drum visible thereby to form a toner image; and an opening part from which said photoconductor drum is partially exposed in the longitudinal direction, wherein said photoconductor drum and the development roller are held in the process cartridge; and said process cartridge further comprising: a first member that is attached to one end in the longitudinal direction of said process cartridge, and holds said photoconductor drum and the development roller spatially, a second member that is attached to a rotational shaft end of said photoconductor drum to obstruct rotation of said photoconductor drum, and a protective cover that covers said photoconductor drum and said development roller when the protective cover is attached to said process cartridge.

13. The process cartridge according to claim 12, wherein said photoconductor drum protective cover covers said opening part and is provided detachably from the process cartridge, and said first member is previously attached to said photoconductor drum protective cover.

14. The process cartridge according to claim 13, wherein said first member, correspondingly to the attachment and detachment operations of said photoconductor drum protective cover, is attached to or detached from one end part in the longitudinal direction of said process cartridge.

15. The process cartridge according to claim 12, wherein a spline which is fitted to a photoconductor drive shaft for transmitting the drive force by spline coupling provided for the apparatus body when the process cartridge is attached to the image forming apparatus body is formed at the shaft end of said photoconductor drum, and said second member has a spline fitted to the spline formed at the rotational shaft end of said photoconductor drum.

16. The process cartridge according to claim 15, wherein regarding a first spline formed axially at said photoconductor drum, and a second spline formed at said second member, in one or both of said first spline and said second spline, at least one spline part of said first spline is longer than other first spline parts, or at least one spline part of said second splines is longer than other second spline parts.

17. The process cartridge according to claim 15, wherein a leading end of said first spline and a leading end of said second spline are provided respectively with a taper in order to smooth fitting in attachment of the second member.

18. The process cartridge according to claim 17, wherein said taper is formed in an axial direction of an axis of said photoconductor drum and the rotational direction of said photoconductor drum and said second member.

19. An image forming apparatus comprising:

a photoconductor drum on which an electrostatic latent image corresponding to a toner image is formed;

a development roller which makes the electrostatic latent image on said photoconductor drum visible thereby to form the toner image;

a process cartridge which holds said photoconductor drum and said development roller; and a protective cover which is attachable to said process cartridge and has a tongue part that enters a nip part between said photoconductor drum and said development roller from an axial direction of an axis of said photoconductor drum when the protective cover is attached to said process cartridge thereby to space said photoconductor drum and said development roller;

wherein said process cartridge includes an opening part from which said photoconductor drum is partially exposed in the longitudinal direction, and a first member that is attached to one end in the longitudinal direction of said process cartridge, holds said photoconductor drum and the development roller spatially; and wherein a photoconductor drum protective cover that covers said opening part is provided detachably from the process cartridge, and said first member is previously attached to said photoconductor drum protective cover.

20. The image forming apparatus according to claim 19, wherein said first member, correspondingly to the attachment and detachment operations of said photoconductor drum protective cover, is attached to or detached from one end part in the longitudinal direction of said process cartridge.

21. An image forming apparatus comprising:

a photoconductor drum on which an electrostatic latent image corresponding to a toner image is formed;

a development roller which makes the electrostatic latent image on said photoconductor drum visible thereby to form a toner image;

a process cartridge which holds said photoconductor drum and said development roller, and holds an axial end part in an axial direction of an axis of said photoconductor drum in the exposed state; and a protective member which is attached to said process cartridge in a state where it is fitted to said exposed axial end part of said photoconductor drum thereby to inhibit rotation of said photoconductor drum;

wherein said process cartridge includes an opening part from which said photoconductor drum is partially exposed in the longitudinal direction, and a second member that is attached to a rotational shaft end of said photoconductor drum to obstruct rotation of said photoconductor drum; and wherein a spline which is fitted to a photoconductor drive shaft for transmitting the drive force by spline coupling provided for the apparatus body when the process cartridge is attached to the image forming apparatus body is formed at the shaft end of said photoconductor drum, and said second member has a spline fitted to the spline formed at the rotational shaft end of said photoconductor drum.

22. The image forming apparatus according to claim 21, wherein regarding a first spline formed axially at said photoconductor drum, and a second spline formed at said second member, in one or both of said first spline and said second spline, at least one spline part of said first spline is longer than other first spline parts, or at least one spline part of said second splines is longer than other second spline parts.

23. The image forming apparatus according to claim 22, wherein a leading end of said first spline and a leading end of said second spline are provided respectively with a taper in order to smooth filling in attachment of the second member.

24. The image forming apparatus according to claim 23, wherein said taper is formed in an axial direction of an axis of said photoconductor drum and the rotational direction of said photoconductor drum and said second member.

25. A process cartridge comprising:

a photoconductor drum that rotates in the circumferential direction, on which an electrostatic latent image corresponding to a toner image is formed;

a development roller that is arranged opposed to said photoconductor drum, and makes said electrostatic latent image formed on said photoconductor drum visible thereby to form a toner image; and an opening part from which said photoconductor drum is partially exposed in the longitudinal direction, wherein said photoconductor drum and the development roller are held in the process cartridge; and said process cartridge further comprising: a first member that is attached to one end in the longitudinal direction of said process cartridge, and holds said photoconductor drum and the development roller spatially and a second member that is attached to a rotational shaft end of said photoconductor drum to obstruct rotation of said photoconductor drum; and wherein a photoconductor drum protective cover that covers said opening part is provided detachably from the process cartridge, and said first member is previously attached to said photoconductor drum protective cover.

26. The process cartridge according to claim 25, wherein said first member, correspondingly to the attachment and detachment operations of said photoconductor drum protective cover, is attached to or detached from one end part in the longitudinal direction of said process cartridge.

27. A process cartridge comprising:

a photoconductor drum that rotates in the circumferential direction, on which an electrostatic latent image corresponding to a toner image is formed;

a development roller that is arranged opposed to said photoconductor drum, and makes said electrostatic latent image formed on said photoconductor drum visible thereby to form a toner image; and an opening part from which said photoconductor drum is partially exposed in the longitudinal direction, wherein said photoconductor drum and the development roller are held in the process cartridge; and said process cartridge further comprising: a first member that is attached to one end in the longitudinal direction of said process cartridge, and holds said photoconductor drum and the development roller spatially and a second member that is attached to a rotational shaft end of said photoconductor drum to obstruct rotation of said photoconductor drum; and wherein a spline which is fitted to a photoconductor drive shaft for transmitting the drive force by spline coupling provided for the apparatus body when the process cartridge is attached to the image forming apparatus body is formed at the shaft end of said photoconductor drum, and said second member has a spline fitted to the spline formed at the rotational shaft end of said photoconductor drum.

28. The process cartridge according to claim 27, wherein regarding a first spline formed axially at said photoconductor drum, and a second spline formed at said second member, in one or both of said first spline and said second spline, at least one spline part of said first spline is longer than other first spline parts, or at least one spline part of said second splines is longer than other second spline parts.

29. The process cartridge according to claim 27, wherein a leading end of said first spline and a leading end of said second spline are provided respectively with a taper in order to smooth fitting in attachment of the second member.

30. The process cartridge according to claim 29, wherein said taper is formed in an axial direction of an axis of said photoconductor drum and the rotational direction of said photoconductor drum and said second member.

* * * * *

UNITED STATES PATENT AND TRADEMARK OFFICE

CERTIFICATE OF CORRECTION

PATENT NO. : 7,062,201 B2
APPLICATION NO. : 10/984969
DATED : June 13, 2006
INVENTOR(S) : Y. Mizoguchi It is certified that error appears in the above-identified patent and that said Letters Patent is hereby corrected as shown below:

At column 6, line 44 (claim 2, line 6) of the printed patent, before “holds” delete “arid”.

At column 9 line 37 (claim 23, line 4) of the printed patent, “filling” should be --fitting--.

Signed and Sealed this

Twenty-seventh Day of November, 2007

JON W. DUDAS
*Director of the United States Patent and Trademark Office*